US008303230B2

(12) United States Patent
Hama

(10) Patent No.: US 8,303,230 B2
(45) Date of Patent: Nov. 6, 2012

(54) BOOKBINDING APPARATUS

(75) Inventor: Riichi Hama, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1022 days.

(21) Appl. No.: 11/892,912

(22) Filed: Aug. 28, 2007

(65) Prior Publication Data

US 2008/0267735 A1 Oct. 30, 2008

(30) Foreign Application Priority Data

Apr. 26, 2007 (JP) ..... 2007-116541

(51) Int. Cl.
*B42C 11/04* (2006.01)
*B42C 11/00* (2006.01)

(52) U.S. Cl. ..... 412/13; 412/11; 412/19; 412/37

(58) Field of Classification Search ..... 118/241, 118/242; 270/58.08, 58.09; 412/11, 13, 412/14, 18, 19, 20, 21, 33, 37; 700/28
See application file for complete search history.

(56) References Cited

U.S. PATENT DOCUMENTS

| | | | | |
|---|---|---|---|---|
| 4,863,332 | A * | 9/1989 | Wiholm et al. | 412/37 |
| 7,694,947 | B2 * | 4/2010 | Marsh | 270/58.09 |
| 8,057,149 | B2 * | 11/2011 | Kaneko | 412/13 |
| 2002/0061241 | A1 * | 5/2002 | Fischer et al. | 412/37 |
| 2007/0280805 | A1 * | 12/2007 | Sasamoto et al. | 412/11 |
| 2007/0286705 | A1 * | 12/2007 | Sasamoto et al. | 412/13 |

FOREIGN PATENT DOCUMENTS

| | | |
|---|---|---|
| JP | 2001-138664 | 5/2001 |
| JP | 2004-351726 | 12/2004 |

* cited by examiner

*Primary Examiner* — Dana Ross
*Assistant Examiner* — Pradeep C Battula
(74) *Attorney, Agent, or Firm* — Finnegan, Henderson, Farabow, Garrett & Dunner, L.L.P.

(57) ABSTRACT

A bookbinding apparatus for binding a book by coating adhesive on a spine of an aligned sheet bundle and pasting a cover sheet on the adhesive-coated spine, the bookbinding apparatus having: a coating section for coating adhesive on the spine of the sheet bundle with a variable coating thickness of the adhesive; a cover sheet pasting section for pasting a cover sheet on the adhesive-coated spine of the sheet bundle, and a control section for changing a time period from a time when adhesive coating ends to a time when the cover sheet pasting starts according to the coating thickness.

5 Claims, 13 Drawing Sheets

FIG. 13 ( a ) COATING THICKNESS DECISION TABLE

| | COATING THICKNESS CT (mm) | |
|---|---|---|
| SHEET BUNDLE THICKNESS ST (mm) | SHEET KIND | |
| | ORDINARY PAPER | COATED PAPER |
| ST < 5 | 0.6 | 0.8 |
| 5 ≤ ST < 10 | 0.8 | 1.0 |
| 10 < ST | 1.0 | 1.2 |

FIG. 13 ( b ) TB1

| COATING THICKNESS CT (mm) | T1 (SECOND) |
|---|---|
| CT < 0.8 | 0 |
| 0.8 ≤ CT <1.2 | 2 |
| 1.2 < CT | 3 |

FIG. 13 ( c ) TB2

| COATING THICKNESS CT (mm) | T2 (SECOND) |
|---|---|
| CT < 0.8 | 0 |
| 0.8 ≤ CT <1.2 | 1 |
| 1.2 < CT | 2 |

FIG. 13 ( d ) TB3

| COATING THICKNESS CT (mm) | T3 (SECOND) |
|---|---|
| CT < 0.8 | 3 |
| 0.8 ≤ CT <1.2 | 6 |
| 1.2 < CT | 8 |

BOOKBINDING APPARATUS

This application is based on Japanese Patent Application No. 2007-116541 filed on Apr. 26, 2007, in Japanese Patent Office, the entire content of which is hereby incorporated by reference.

BACKGROUND

The present invention relates to a bookbinding apparatus for coating adhesive such as paste••on the spine of a sheet bundle, thereby performing a binding process, and pasting a cover sheet on the adhesive-coated spine.

A bookbinding apparatus for stacking sheets outputted from an image forming apparatus such as a copier or a printer to form a sheet bundle, performing the binding process for the sheet bundle, thereby binding a book is an apparatus used generally widely.

As a binding apparatus, there are a stapling device and a pasting device available, though when giving priority to good spreads, the pasting device is adopted.

Pasting must be executed surely so as to prevent sheets of the book-bound sheet bundle from coming out and to form the pasting surface in a uniform plane shape.

To respond to such a requirement, there is a proposal of a bookbinding apparatus for adjusting the amount of adhesive to be coated on the spine of a sheet bundle according to the thickness of the sheet bundle (for example, refer to Unexamined Japanese Patent Application Publication No. 2000-168265).

Bookbinding referred to as wrapping bookbinding for pasting one sheet (referred to as a cover sheet) composed of a cover sheet, a spine sheet, and a back cover sheet to the sheet bundle pasted in this way, then bending it in accordance with both edges of the spine of the sheet bundle, thereby binding a book is also executed.

In wrapping bookbinding finished satisfactorily, the square spine formed by bending a cover sheet along both edges of the spine of the sheet bundle is formed linearly and at right angles.

However, the square spine may not be formed linearly or in certain circumstances, a part of the adhesive coated on the spine may be non-uniformly forced out on the top page or last page of the sheet bundle.

Such a fault should be suppressed as far as possible from the viewpoint of bookbinding quality.

SUMMARY

One aspect of the present invention is a bookbinding apparatus for binding a book by coating adhesive on a spine of an aligned sheet bundle and pasting a cover sheet on the adhesive-coated spine, the bookbinding apparatus comprising: a coating section for coating adhesive on the spine of the sheet bundle with a variable coating thickness of the adhesive; a cover sheet pasting section for pasting a cover sheet on the adhesive-coated spine of the sheet bundle, and a control section for changing a time period form a time when adhesive coating ends to a time when the cover sheet pasting starts according to the coating thickness.

Another aspect of the present invention is a bookbinding apparatus for binding a book by coating adhesive on a spine of an aligned sheet bundle and pasting a cover sheet on the adhesive-coated spine, the bookbinding apparatus comprising: a coating section for coating adhesive on the spine of the sheet bundle with a variable coating thickness of the adhesive; a cover sheet pasting section for pasting a cover sheet on the adhesive-coated spine of the sheet bundle, a sheet bending section for bending the cover sheet pasted to the spine of the sheet bundle along the side edges of the spine and holding simultaneously the cover sheet and the sheet bundle, and a control section for changing at least one of a plurality of time periods consisting of A) a time period from a time when adhesive coating ends to a time when the cover sheet pasting starts, B) a time period from a time when the cover sheet pasting ends to a time when the sheet bending section starts bending the cover sheet and C) a time period of holding simultaneously the cover sheet and the sheet bundle, according to the coating thickness.

BRIEF DESCRIPTION OF THE DRAWINGS

FIGS. 13(*a*) to 13(*d*) are examples of the coating thickness decision table and tables TB1, TB2, and TB3.

DETAILED DESCRIPTION OF THE PREFERRED EMBODIMENTS

Hereinafter, the embodiments of the present invention will be explained with reference to the accompanying drawings.

Figure 1:
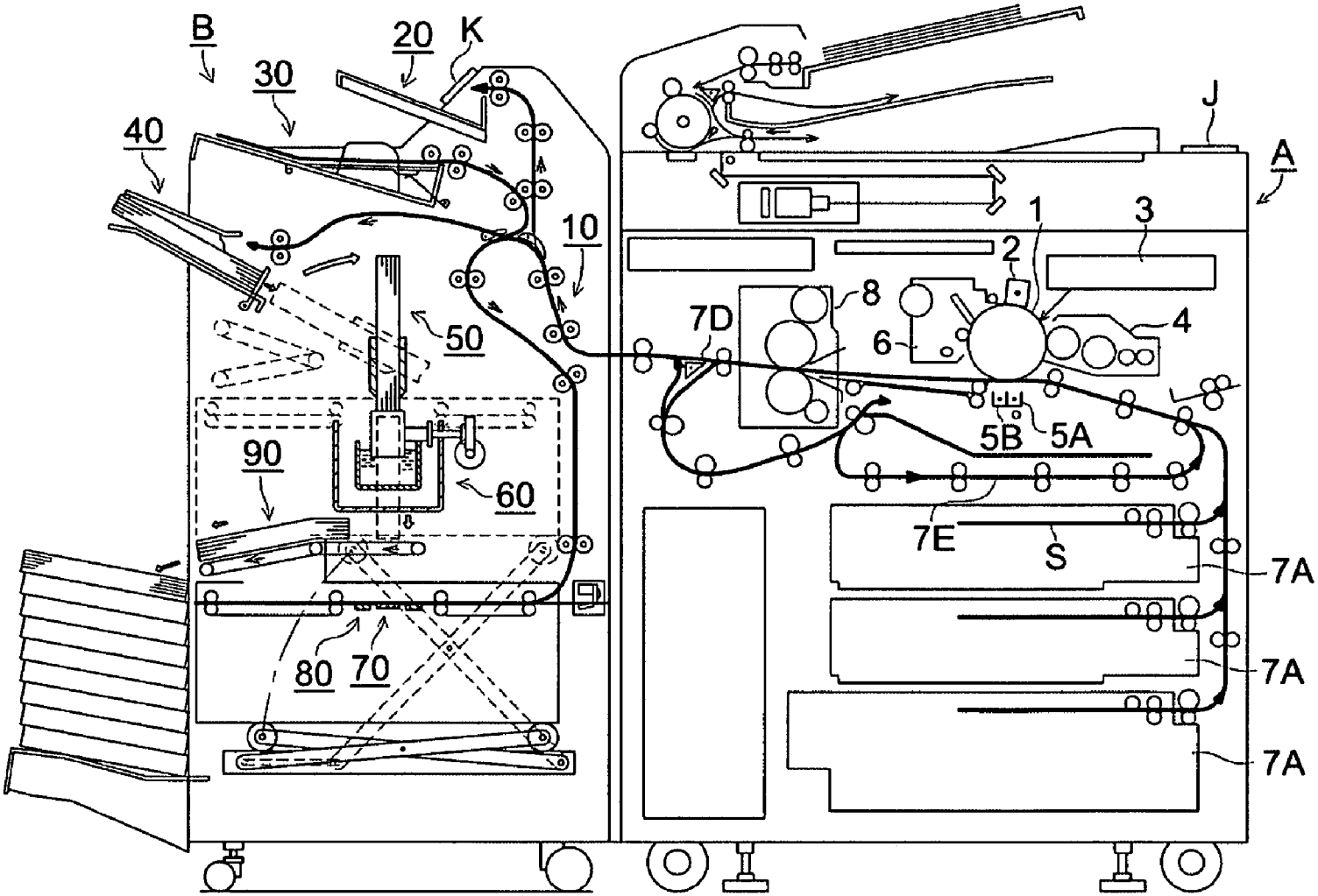
FIG. 1 is a conceptual diagram of the bookbinding system that the image forming apparatus and bookbinding apparatus are connected.
Figure 2:
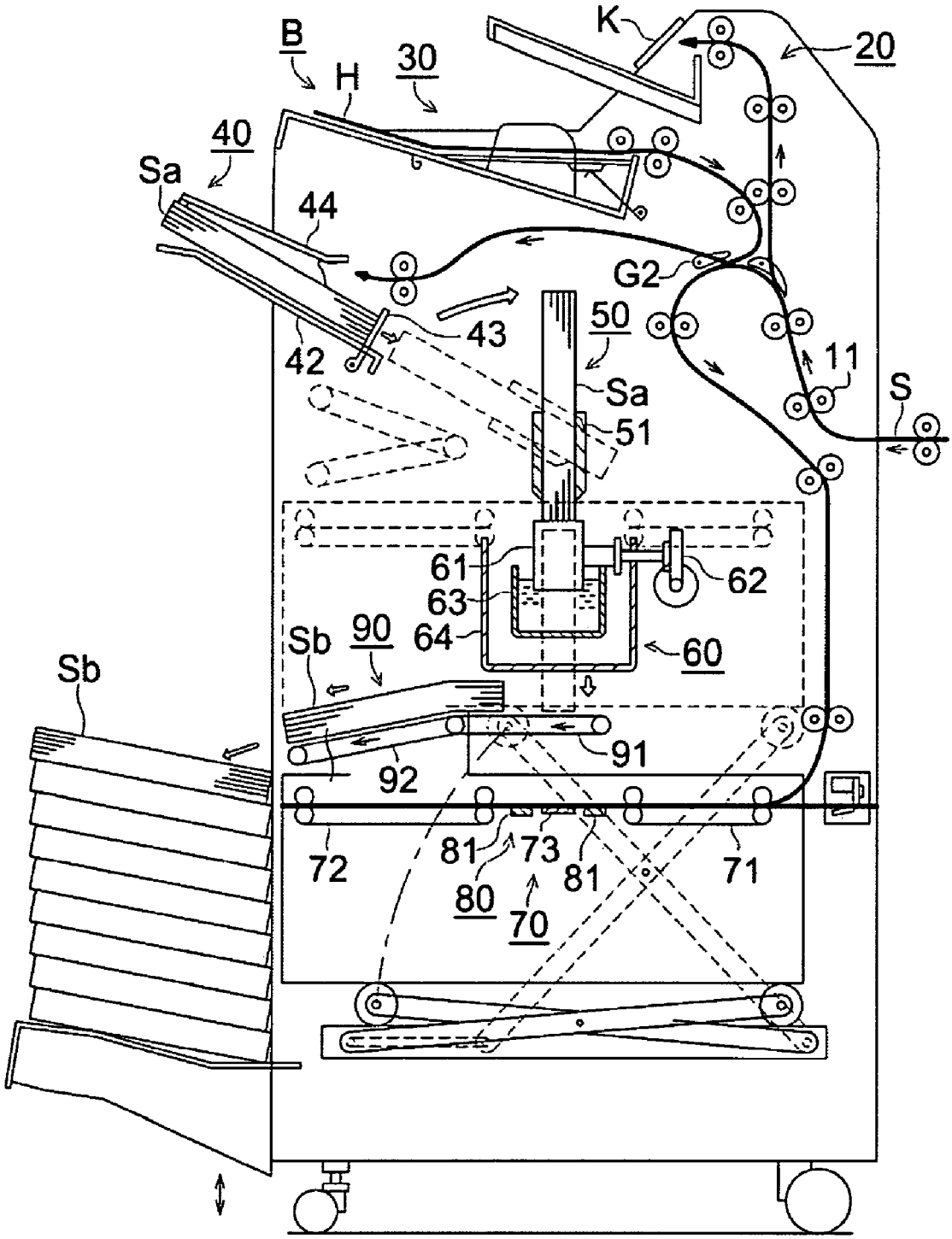
FIG. 2 is a conceptual diagram of the bookbinding apparatus.

FIG. 1 is a conceptual diagram of the bookbinding system that an image forming apparatus A and a bookbinding apparatus B are connected. And, FIG. 2 is a conceptual diagram of the bookbinding apparatus B.

The image forming apparatus A is a well-known apparatus for forming an image on a sheet S by an electrophotographic art and around a rotary image carrier 1, a charger 2, a writing unit 3, a developing unit 4, a transfer unit 5A, a discharger 5B, and a cleaning unit 6 are arranged.

On the image carrier member 1 charged uniformly by the charger 2, a latent image is formed by scanning exposure with a laser beam of the writing unit 3 based on image data.

And a toner image is formed on the surface of the image carrier by reversely developing the latent image with the developing unit 4.

The toner image is transferred onto the sheet S sent from a sheet storing section 7A by the transfer unit 5A and the sheet S carrying the toner image is separated from the surface of the image carrier 1 by the action of the discharger 5B and is sent to a fixing unit 8.

The sheet S carrying the toner image sent to the fixing unit 8 is pressured and heated, thus the toner image is fixed to the sheet S and is ejected toward the bookbinding apparatus B.

When forming images on both sides of the sheet S, the sheet S sent from the fixing unit 8 is led downward by a conveyance path switching member 7D, is subject to a front-rear reverse process by a reverse and conveyance section 7E, is sent again to the transfer section, is subject to image formation and fixing processing, and is sent to the bookbinding apparatus B.

Further, the surface of the image carrier 1 finishing transfer of the toner image is removed residual toner by the cleaning unit 6 and is subject to the next image formation.

The bookbinding apparatus B is a bookbinding apparatus for preparing a booklet from the sheets S sent from the image forming apparatus A and is composed of a sheet conveying section 10, a sheet ejection section 20, a cover sheet feeding section 30, a sheet storing section 40, a sheet bundle conveying section 50, a adhesive coating section 60, a cover sheet pasting section 70, a cover sheet bending section 80, and a booklet ejection section 90.

Further, the bookbinding apparatus B can be used as a single apparatus.

The sheet conveying section 10 is a section for conveying the sheets S sent from the image forming apparatus A and cover sheets H sent from the cover sheet feeding section 30 to a predetermined position by a plurality of rollers and a guide member.

The sheet ejection section 20 is a tray for storing the sheets S not subject to the bookbinding process and is a section for sequentially stacking the sheets S image-formed by the image forming apparatus A.

The cover sheet feeding section 30 is a section for sequentially sending the cover sheets H loaded on the sheet feeding tray to the sheet conveying section 10.

The sheet storing section 40 is a section for switch-back-conveying the sent sheets S one by one, sequentially stacking them, aligning them for each preset number of sheets, and forming a sheet bundle Sa.

The sheet bundle conveying section 50 is a section for holding the sheet bundle Sa conveyed obliquely downward from the sheet storing section 40 by a holding member 51, moving the sheet bundle Sa held by the holding member 51 to a predetermined position above the adhesive coating section 60 by rotating it so as to position the spine of the sheet bundle Sa at the bottom, and permitting it to hold the sheet bundle Sa at that position.

The adhesive coating section 60 is a coating section, by moving in the longitudinal direction of the spine of the sheet bundle Sa held by the sheet bundle conveying section 50, for coating adhesive on the spine in a predetermined thickness corresponding to the thickness of the sheet bundle Sa and the sheet kind.

The cover sheet pasting section 70 is a section for pressurizing and pasting the cover sheet H fed from the cover sheet feeding section 30 on the adhesive-coated spine of the sheet bundle Sa held upward by the sheet bundle conveying section 50.

The cover sheet bending section 80 is a section installed on the upper part of the cover sheet pasting section 70, by the operation of a pair of bending members moving vertically and horizontally, for bending the cover sheet H pasted to the spine of the sheet bundle Sa along the side edges of the spine, thereby giving a cover sheet and a back cover sheet to the sheet bundle Sa.

The booklet ejection section 90 is a section for conveying the booklet which is bound and is given the cover sheet and back cover sheet by the belt and ejecting it outside the apparatus.

Further, on the image forming apparatus A and bookbinding apparatus B, an operation display section J and an operation display section K which are a well-known I/O unit are respectively installed.

Figure 3:
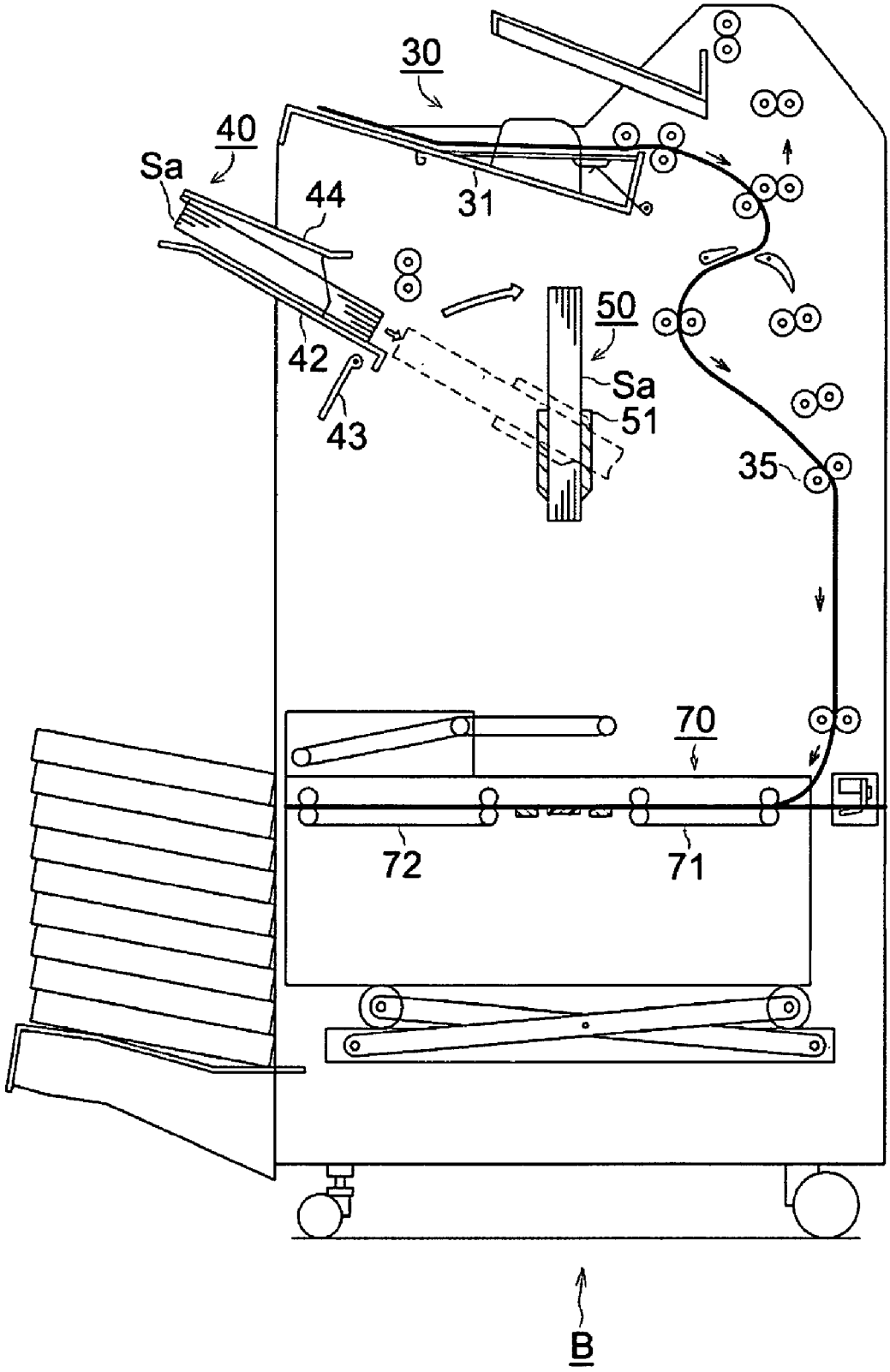
FIG. 3 is a drawing for explaining the sheet bundle storing section and sheet bundle conveying section.

FIG. 3 is a drawing for explaining the sheet bundle storing section 40 and sheet bundle conveying section 50.

The sheets S sequentially stacked on a sheet loading table 42 arranged obliquely are aligned by a first aligning member 43 rotatably installed for controlling the stop position of the end face which is the spine of the sheet bundle Sa and a second aligning member 44 for controlling the positions of the end faces which are the top and bottom of the sheet bundle Sa.

The sheet bundle Sa aligned, by a push-out member not drawn, is sent obliquely downward, is held by a holding member 51 of the sheet bundle conveying section 50, is rotated so as to direct the spine downward, and is stopped upright as shown by the solid line in the drawing.

Figure 4:
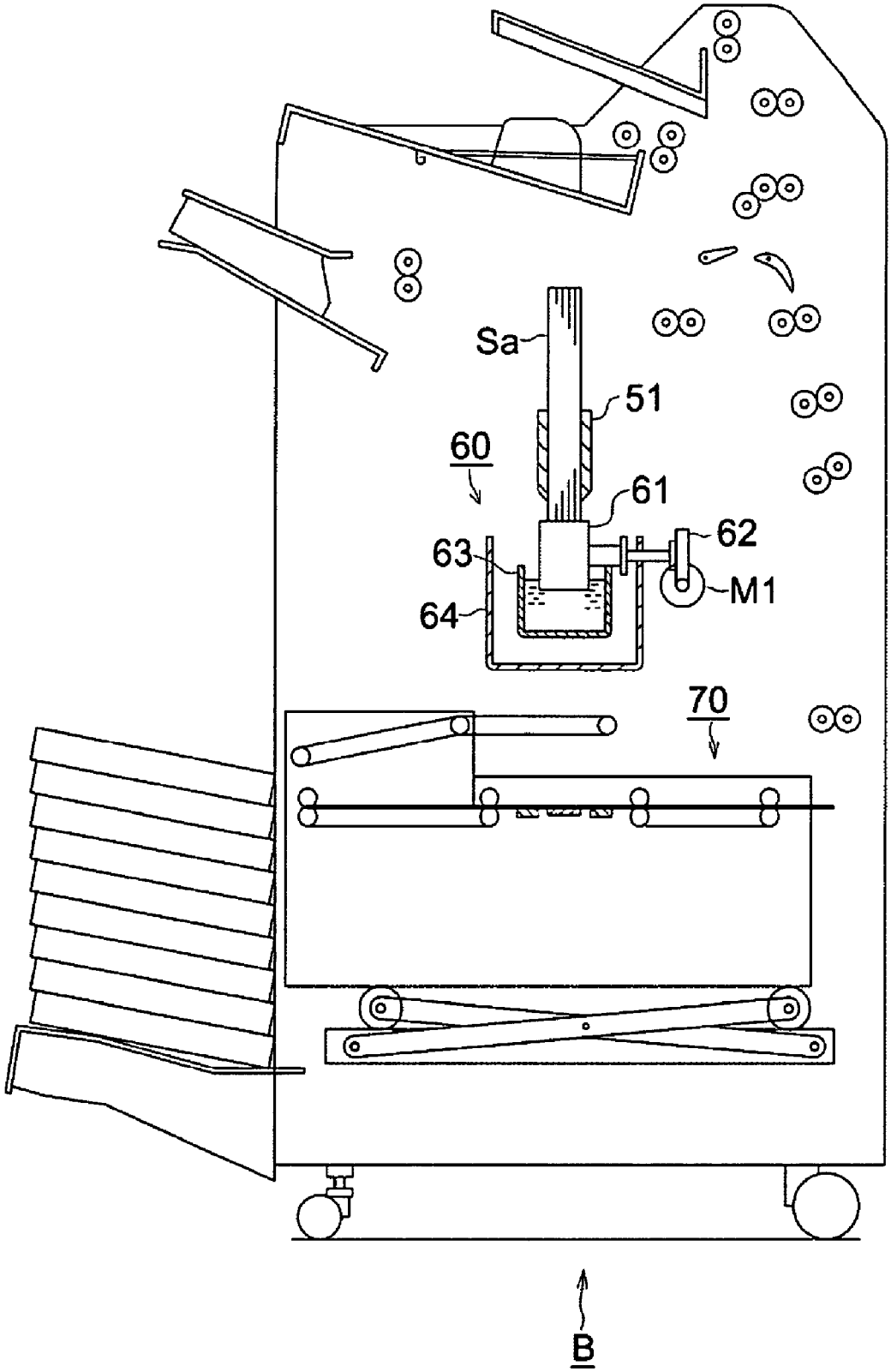
FIG. 4 is a drawing showing the arrangement of the adhesive coating section.
Figure 5:
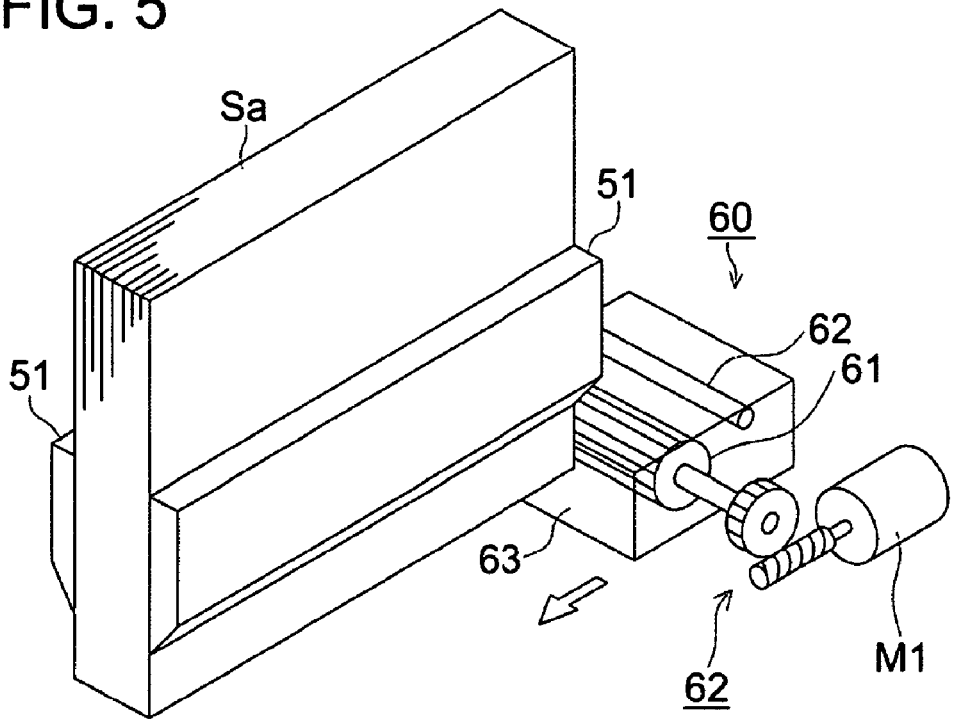
FIG. 5 is a conceptual diagram of the adhesive coating section.

FIG. 4 is a drawing showing the arrangement of the adhesive coating section 60. Further, FIG. 5 is a conceptual diagram of the adhesive coating section 60.

The adhesive coating section 60, by a coating roller 61 rotating and moving in the longitudinal direction of the spine of the sheet bundle Sa, coats adhesive stored in a adhesive container 63 on the spine of the sheet bundle Sa.

Figure 6:
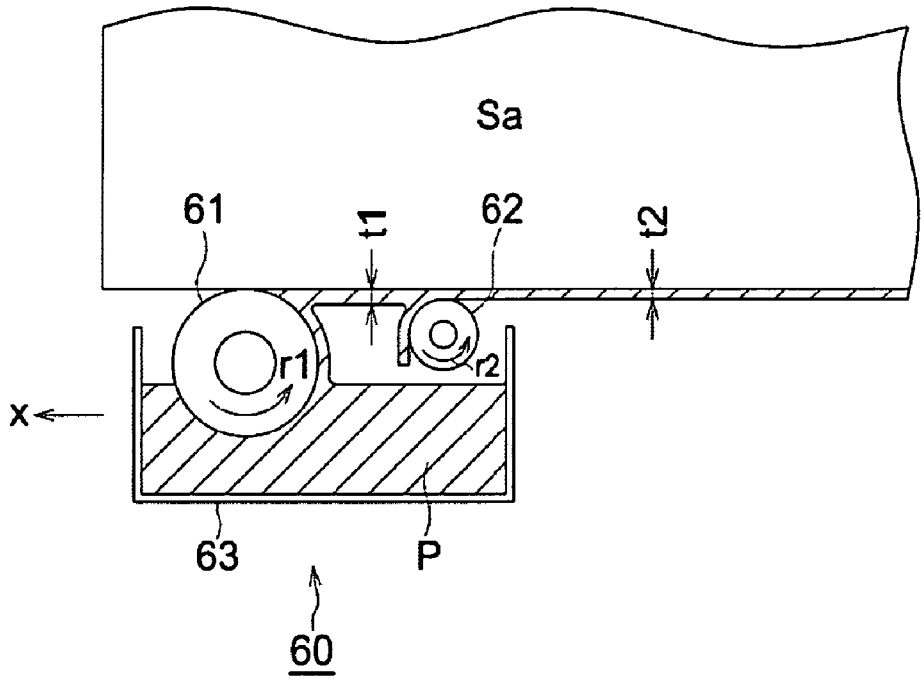
FIG. 6 is a drawing for explaining the relationship between the movement of the adhesive coating section and the coating thickness.

FIG. 6 is a drawing for explaining the relationship between the movement of the adhesive coating section 60 and the coating thickness.

The adhesive coating section 60 moves in the direction of an arrow x shown in the drawing, and adhesive P (the hatched part in the drawing) in the adhesive container 63 is led to the spine of the sheet bundle Sa by a coating roller 61 rotating in the direction of an arrow r1, and adhesive with a thickness of t1 is coated on the sheet bundle Sa.

The adhesive coated with the thickness t1, to control it to a predetermined thickness t2, is partially scraped by a scraping roller 62 rotating in the direction of an arrow r2.

The scraped adhesive is scraped from the surface of the roller by a scraping plate (not drawn) in contact with the surface of the scraping roller 62 and is returned again to the adhesive container 63.

The predetermined coating thickness t2 can be changed by changing the distance between the spine of the sheet bundle Sa and the scraping roller 62.

Figure 7:
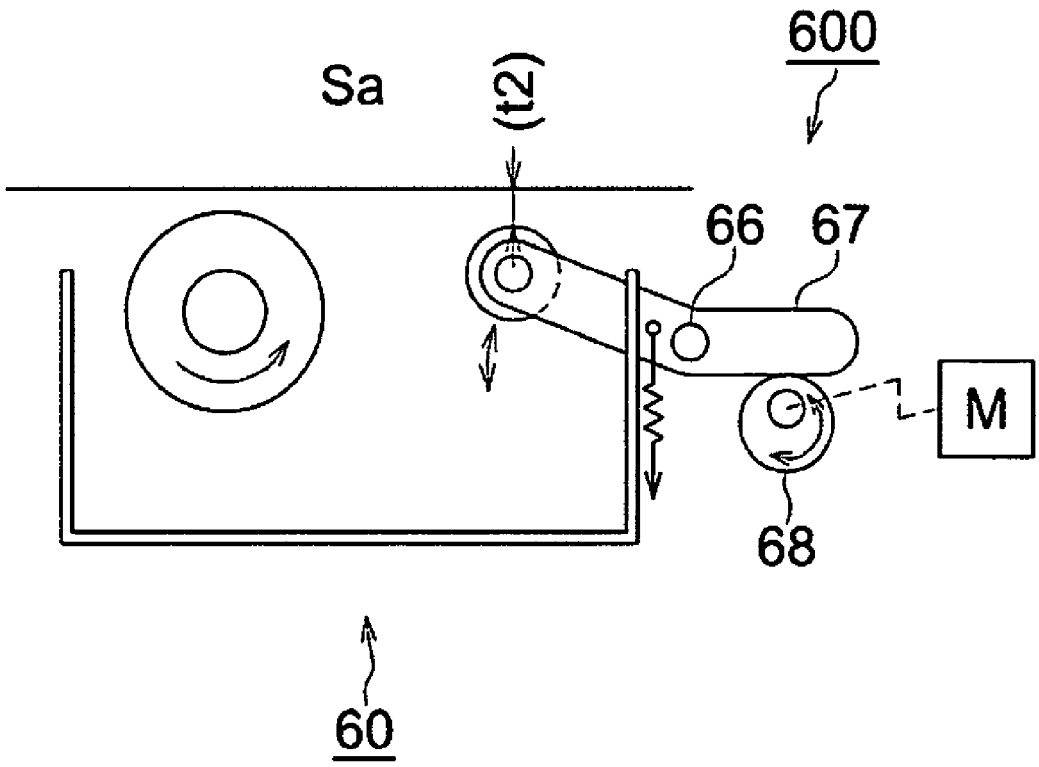
FIG. 7 is a drawing for explaining the coating thickness changing section.

FIG. 7 is a drawing for explaining a coating thickness changing section 600 for changing the adhesive coating thickness.

The coating thickness changing section 600 is installed so as to be attached to the adhesive coating section 60 and the scraping roller 62 is attached to one end part of a support member 67 rotating around a rotary shaft 66.

With the other end part of the support member 67, an eccentric cam 68 controlled in the rotational angle by a stepping motor M is in contact and depending on the stop position of the eccentric cam 68, the distance between the scraping roller 62 and the spine of the sheet bundle Sa is changed.

Namely, the coating thickness changing section 600 is a section for controlling the coating thickness t2 by controlling the rotational angle from a preset reference stop position of the stepping motor M.

Further, the coating thickness t2 is decided by the thickness of the sheet bundle Sa or the number of sheets and the kind of sheets S composing the sheet bundle Sa.

The aforementioned decision of the coating thickness t2 is made by execution of the bookbinding condition change control which is a program for deciding the coating thickness from the information on the thickness of the sheets S and the number and kind of sheets composing the sheet bundle Sa inputted by the operation display section J of the image forming apparatus A or the operation display section K of the bookbinding apparatus B and from a coating thickness decision table 200 stored beforehand in a memory M.

In the aforementioned example of the decision of the coating thickness t2, it is decided on the basis of the information inputted by the operation display section J of the image forming apparatus A or the operation display section K of the bookbinding apparatus B, though it may be decided on the basis of the measured value obtained by measuring the thickness of the sheet bundle Sa from the movement distance of the holding member 51 of the sheet bundle conveying section 50 for holding the sheet bundle Sa and the sheet kind information inputted from the operation display section.

Generally, the coating thickness t2 is decided so as to increase as the thickness of the sheet bundle Sa increases and so as to increase in a sheet kind having a low adhesion strength like coated paper.

Figure 8:
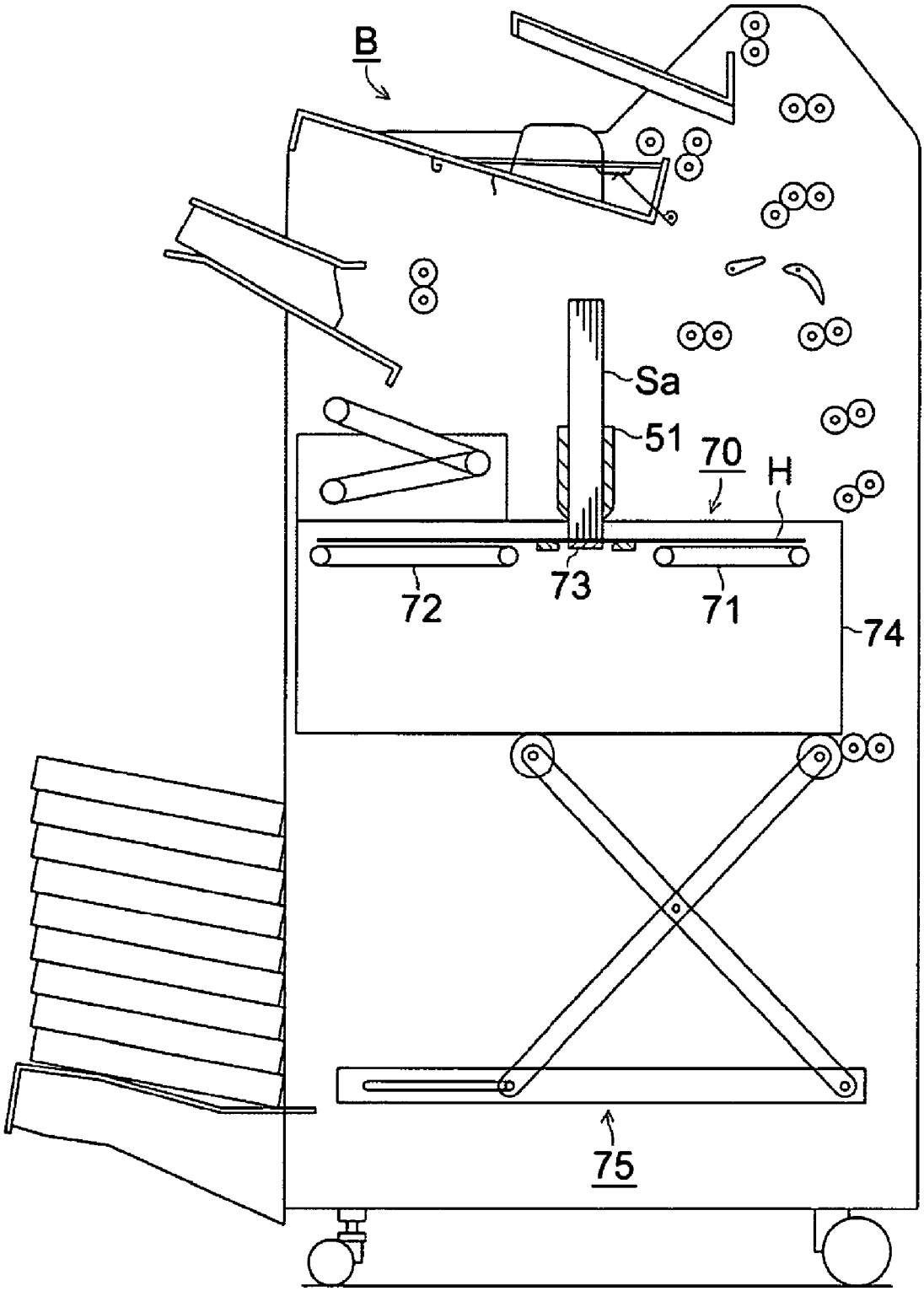
FIG. 8 is a drawing for explaining the cover sheet pasting section.

FIG. 8 is a drawing for explaining the cover sheet pasting section 70.

The cover sheet H sent from the cover sheet feeding section 30 is stopped at a predetermined position by conveying belts 71 and 72, then rises by being held by the cover sheet pasting section 70 rising by a rise-and-fall section 75, and is pressurized and pasted on the spine of the adhesive-coated sheet bundle Sa by a pressure-contact member 73 rising simultaneously.

Figure 9:
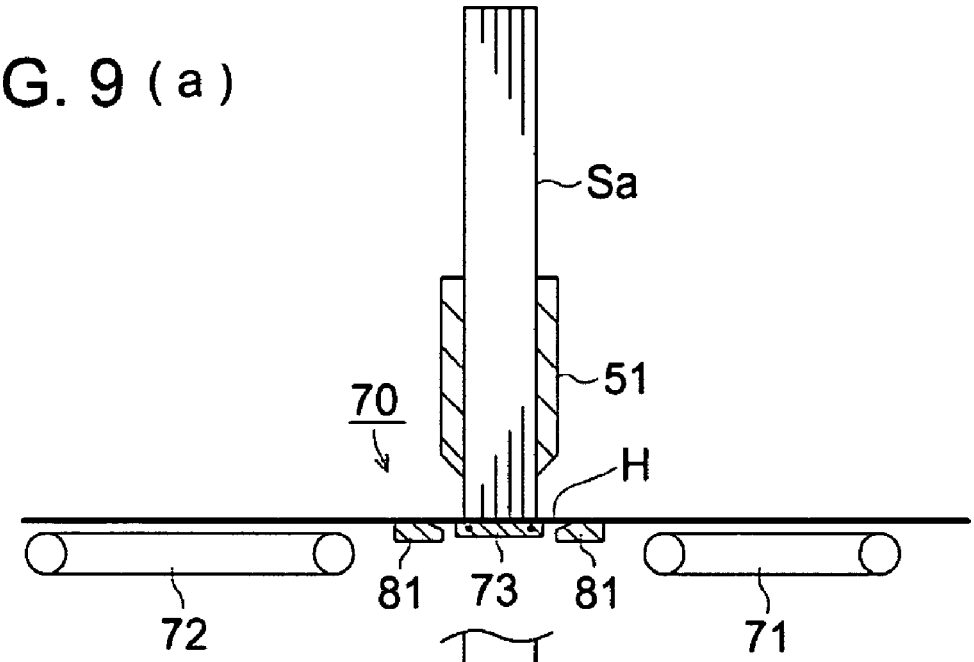
FIGS. 9(*a*) to 9(*d*) are drawings for explaining the bending operation of the cover sheet bending section.
Figure 9:
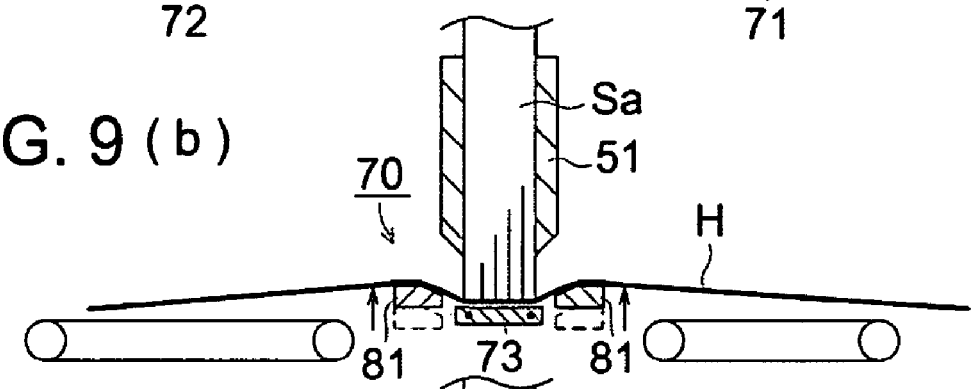
Figure 9:
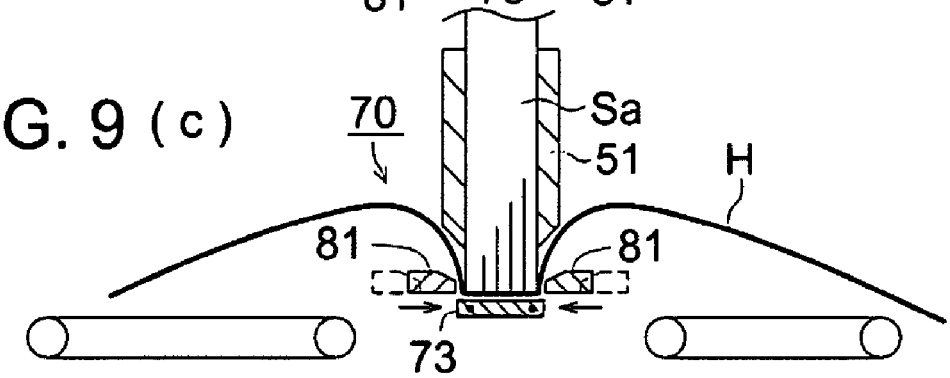
Figure 9:
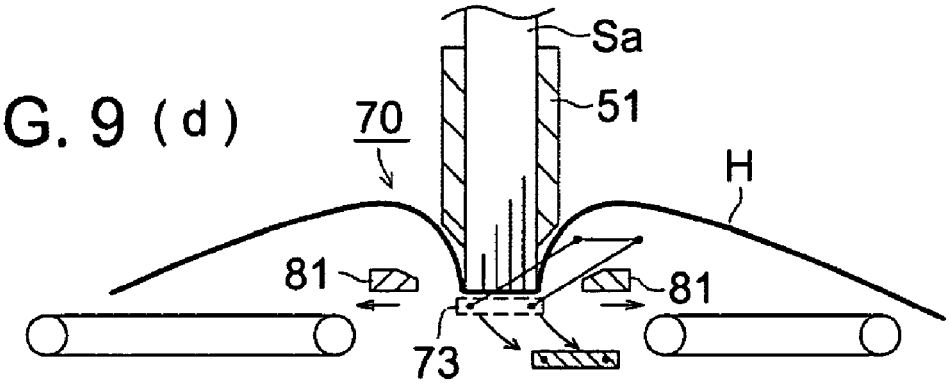

FIGS. 9(*a*), 9(*b*), 9(*c*), and 9(*d*) are drawings for explaining the bending operation of the cover sheet bending section 80.

On the cover sheet bending section 80, a pair of bending members 81 moving vertically and horizontally is installed, and the movement and stop of the bending member 81 are controlled, thus the cover sheet H is bent.

FIG. 9(*a*) is a drawing when the bending of the cover sheet H is started, showing the status that adhesive is coated on the spine of the sheet bundle Sa, and then the cover sheet pasting section 70 rises, thus the cover sheet H is pasted on the spine by the pressure-contact member 73.

FIG. 9(*b*) shows the situation that the pair of bending members 81 rises more by a bending member drive section (not drawn in FIG. 9 but drawn in FIG. 11) and the cover sheet H is bent along the side edges of the spine of the sheet bundle Sa.

FIG. 9(*c*) shows the situation that the pair of bending members 81 moves horizontally by the bending member drive section and holds simultaneously the cover sheet H and sheet bundle Sa, thereby bends the cover sheet H along the side edges of the spine.

FIG. 9(*d*) shows the situation immediately before the sheet bundle Sa which is book-bound by pasting the cover sheet H is sent downward.

Figure 10:
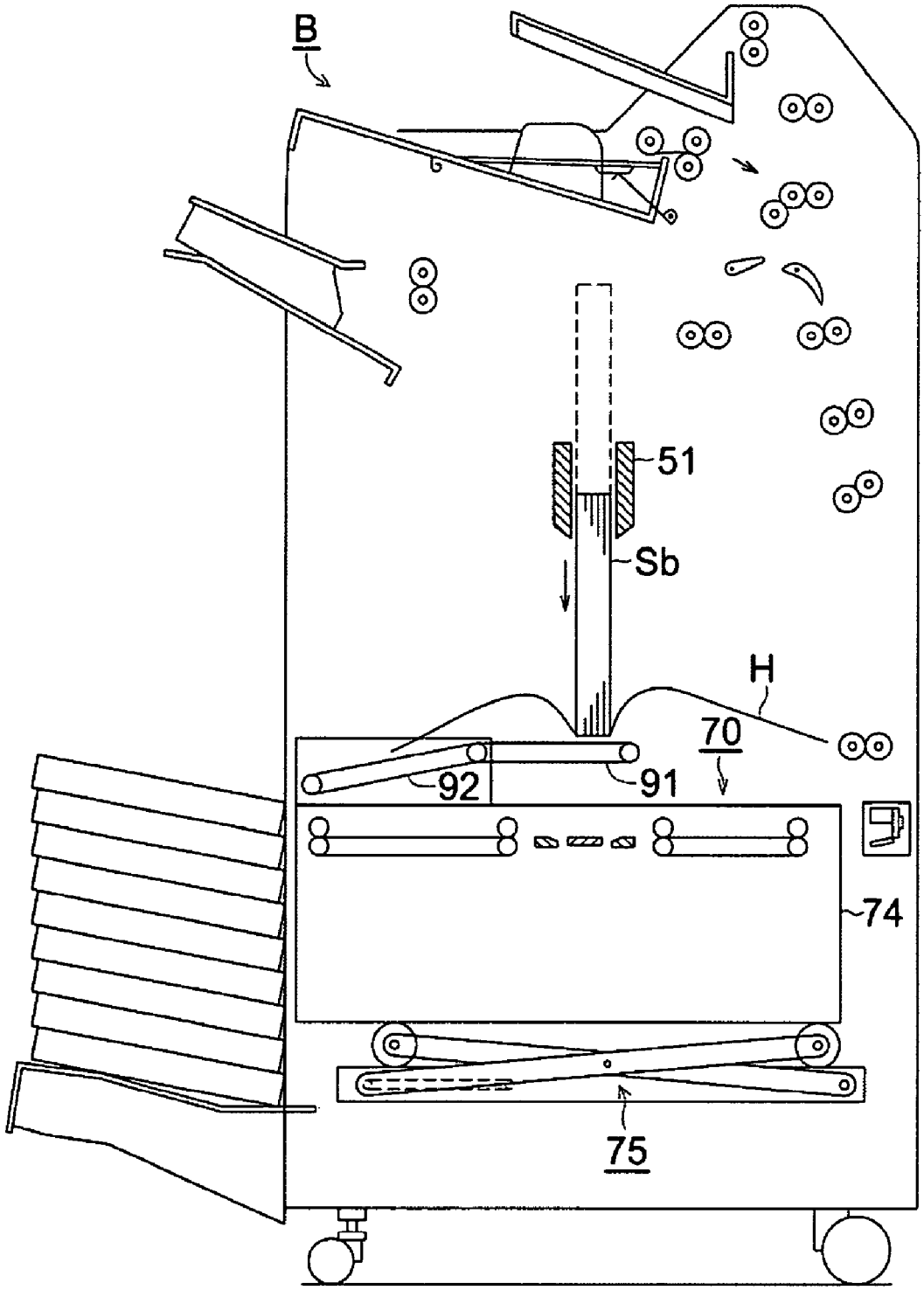
FIG. 10 is a drawing for explaining the booklet ejection section.

FIG. 10 is a drawing for explaining the booklet ejection section 90.

The cover sheet bending section 80 pastes the cover sheet H to the sheet bundle Sa and bends it, and then retreats downward.

When the retreat is finished, ejection belts 91 and 92 of the booklet ejection section 90 move under the book-bound sheet bundle Sa (referred to as a booklet Sb).

When the ejection belts 91 and 92 stop at predetermined positions and start rotation, the holding operation of the holding member 51 for holding the sheet bundle Sa is canceled, and the booklet Sb falls on the lower ejection belts 91 and 92 and is loaded sideways on the belts.

The booklet Sb loaded on the belts is ejected outside the apparatus and is sequentially loaded on the booklet support.

Figure 11:
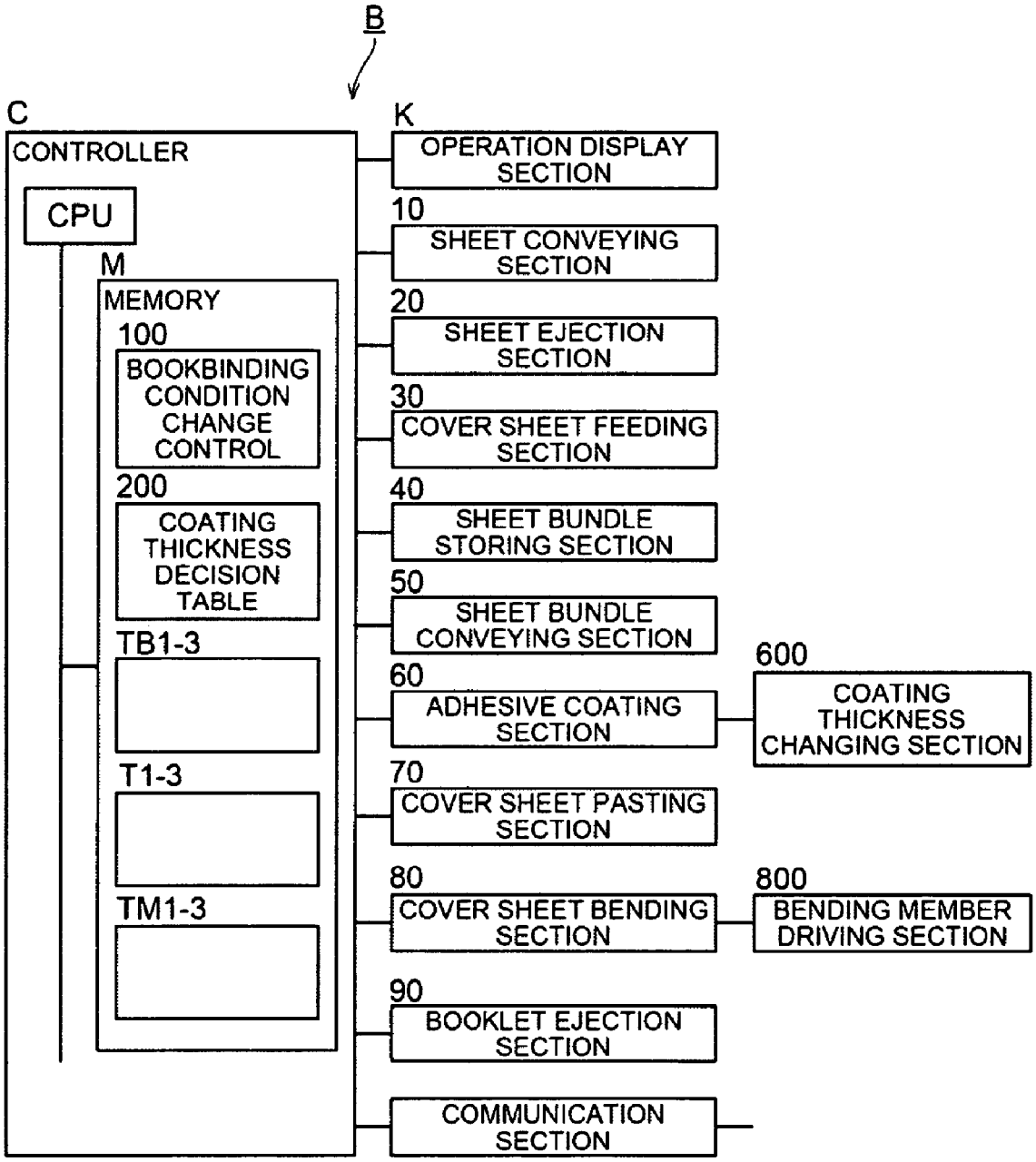
FIG. 11 is a block diagram showing the control relationship of the bookbinding apparatus.

FIG. 11 is a block diagram showing the control relationship of the bookbinding apparatus B.

A controller C is a computer system including a CPU, a memory, an I/O interface, a communication interface, and other various circuits and each control is carried out by executing a predetermined program stored in the memory.

Further, in this drawing, recording of a block not related directly to the explanation of the embodiments of the present invention is omitted.

Figure 12:
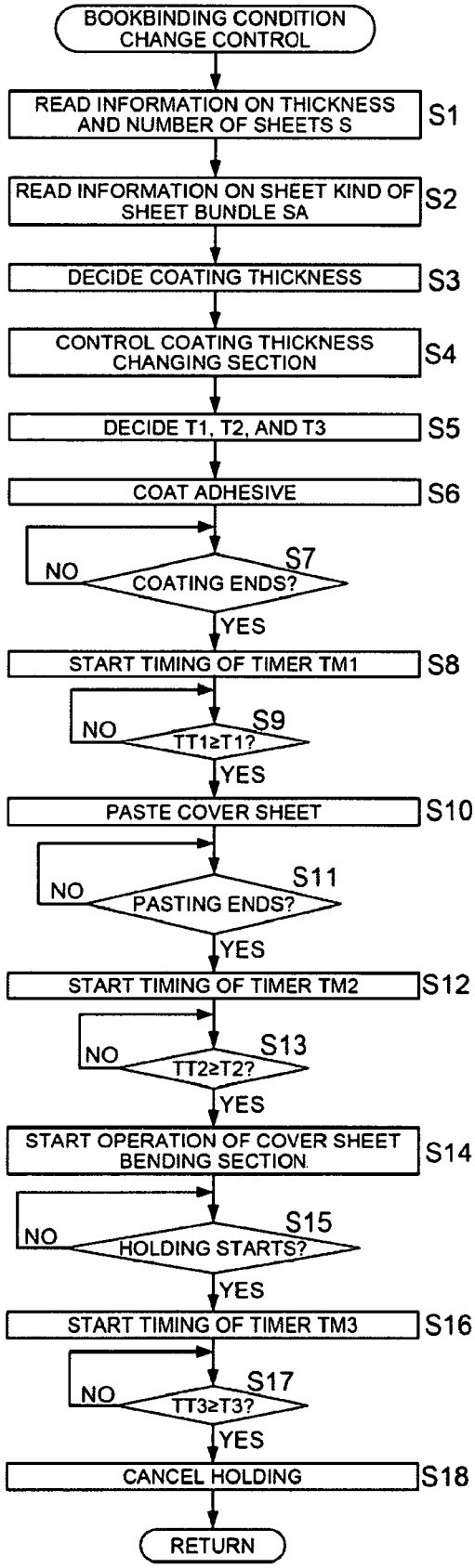
FIG. 12 is a flow chart showing the flow of the bookbinding condition change control.

FIG. 12 is a flow chart showing the flow of bookbinding condition change control 100.

The bookbinding condition change control 100 is a program for changing the coating thickness t2 according to the thickness or kind of the sheet bundle Sa and on the basis of the changed coating thickness t2, for changing the time (T1) from adhesive coating end to cover sheet pasting start, the time (T2) from cover sheet pasting end to operation start of the cover sheet bending section, and the holding time (T3) for holding both the cover sheet H and sheet bundle Sa by the cover sheet bending section 80 and is stored in the memory M of the controller C.

When the execution of the bookbinding condition change control 100 is started, firstly, the information relating to the thickness, number, and kind of the sheets S which is inputted from the operation display section J of the image forming apparatus A or the operation display section K of the bookbinding apparatus B and is stored in the memory M is taken out (Steps S1 and S2).

From the taken-out information, the thickness of the sheet bundle Sa is calculated, and on the basis of the calculated thickness and sheet kind, the preset coating thickness decision table 200 is referred to, and the thickness of adhesive to be coated on the spine of the sheet bundle Sa is decided (Step S3).

Further, as explained already, for the thickness of the sheet bundle Sa, a measured value may be adopted. Further, the coating thickness decision table 200 may use calculation formulas instead of tables and the tables or calculation formulas are decided on the basis of experimentation.

When the coating thickness is decided, the controller C controls the coating thickness changing section 600 of the adhesive coating section 60 and changes the position of the scraping roller to the position corresponding to the decided coating thickness (Step S4).

Further, the controller C refers to a table TB1 for storing the time from adhesive coating end to cover sheet pasting start in a table or formula form in correspondence with the coating thickness and on the basis of the decided coating thickness aforementioned, decides the time (T1) from adhesive coating end to cover sheet pasting start.

Similarly, the controller C refers to a table TB2 and decides the time (T2) from cover sheet pasting end to operation start of the cover sheet bending section 80 and refers to a table TB3 and decides the holding time (T3) for holding both the cover sheet and sheet bundle by the cover sheet bending section 80 (Step S5).

FIGS. 13(*a*), 13(*b*), 13(*c*), and 13(*d*) are examples of the coating thickness decision table 200 and tables TB1, TB2, and TB3.

When the coating process with the coating thickness decided by the adhesive coating section 60 is finished (Y at Steps S6 and S7), a timer TM1 starts timing (Step S8).

When a value TT1 of the timer TM1 reaches a decided value T1 (Y at Step S9), the operation of the cover sheet pasting section 70 is started (Step S10).

When the pasting of the cover sheet H on the spine of the sheet bundle Sa by the cover sheet pasting section 70 is finished (Y at Step S11), a timer TM2 starts timing (Step S12).

When a value TT2 of the timer TM2 reaches a decided value T2 (Y at Step S13), the operation of the cover sheet bending section 80 is started (Step S14).

When the bending members 81 of the cover sheet bending section 80 starts the operation of holding both the cover sheet H and sheet bundle (Y at Step S15), a timer TM3 starts timing (Step S16).

When a value TT3 of the timer TM3 reaches a decided value T3 (Y at Step S17), the holding operation of the bending members 81 is canceled (Step S18) and the process comes out of the routine.

Figure 14:
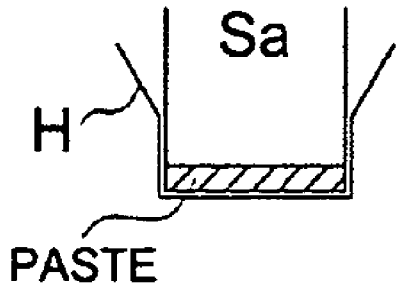
FIGS. 14(*a*) to 14(*d*) are drawings for explaining examples of faults caused when pasting a cover sheet.
Figure 14:
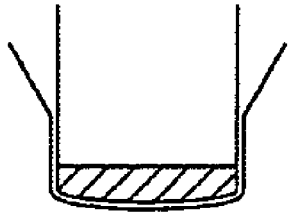
Figure 14:
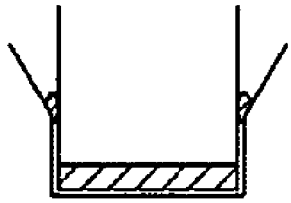
Figure 14:
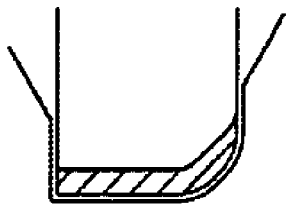

FIGS. 14(*a*), 14(*b*), 14(*c*), and 14(*d*) are drawings for explaining examples of faults caused when adding the cover sheet H to the sheet bundle Sa.

FIG. 14(*a*) shows preferable finish that a square spine is formed precisely.

FIGS. 14(*b*) and 14(*c*) show examples caused when the cover sheet H is pasted and bent before the adhesive is hardened sufficiently and in the examples, as shown in FIG. 14(*b*), the shape of the square spine is rounded or as shown in FIG. 14(*c*), adhesive comes out of the bent cover sheet H.

Further, FIG. 14(*d*) shows the case that the holding time T3 of the cover sheet H by the cover sheet bending section 80 is short and the adhesive is hardened insufficiently and in the example, the spine shocked when the bookbound booklet Sb falls on the booklet ejection section 90 is deformed.

Generally, to prevent such a fault, it is desirable to reserve sufficiently the adhesive coating thickness t2, make the binding process sure, then leave room for the time (T1) from adhesive coating end to cover sheet pasting start, the time (T2) from cover sheet pasting end to operation start of the cover sheet bending section 80, and the holding time (T3) for holding the cover sheet H and sheet bundle Sa, thereby reserve the adhesive hardening time, though a problem arises that the bookbinding under such conditions causes reduction in the processing capacity of the apparatus.

The present invention solves such a problem by deciding a necessary adhesive thickness from the thickness of the sheet bundle Sa and the kind of sheets and on the basis of the decided adhesive thickness, setting the time T1 to T3 aforementioned respectively to minimum time.

By realization of the bookbinding apparatus for executing the control explained above, even if adhesive with a sufficient thickness for making the binding process sure in correspondence with the thickness of the sheet bundle and the kind of sheets is coated on the spine of the sheet bundle, the finish quality of bookbinding is maintained and the apparatus is prevented from reduction in the processing capacity.

What is claimed is:

1. A bookbinding apparatus for binding a book by coating adhesive on a spine of an aligned sheet bundle and pasting a cover sheet on the adhesive-coated spine, the bookbinding apparatus comprising:

a coating section for coating adhesive on the spine of the sheet bundle with a variable coating thickness of the adhesive;

a cover sheet pasting section for pasting a cover sheet on the adhesive-coated spine of the sheet bundle, and a control section including a timer configured to start timing when a coating process by the coating section is finished, wherein the control section is configured to determine a period of time T1 from an end of the coating process to a start of pasting the cover sheet on the adhesive coated spine of the sheet bundle, on the basis of a thickness of the coated adhesive, to start an operation of the cover sheet pasting section when a value of the timer reaches the period of time T1, and to adjust a T1 value to a higher or lower time based on the data of the current book thickness in a case where the current thickness of the sheet bundle compared to the prior thickness of the sheet bundle is of a higher thickness or a lower thickness respectively.

2. The bookbinding apparatus of claim 1, wherein the control section controls the coating section to change a coating thickness based on the thickness of the sheet bundle.

3. The bookbinding apparatus of claim 1, wherein the control section controls the coating section to change a coating thickness based on the kind of sheets comprising the sheet bundle.

4. The bookbinding apparatus of claim 1, further comprising:

a sheet bending section for bending the cover sheet pasted to the spine of the sheet bundle along the side edges of the spine and holding simultaneously the cover sheet and the sheet bundle, wherein the control section changes a time period from a time when the cover sheet pasting ends to a time when the sheet bending section starts bending the cover sheet based on the changed coating thickness.

5. The bookbinding apparatus of claim 1, further comprising:

a sheet bending section for bending the cover sheet pasted to the spine of the sheet bundle along the side edges of the spine and holding simultaneously the cover sheet and the sheet bundle, wherein the control section changes a time period of holding simultaneously the cover sheet and the sheet bundle based on the changed coating thickness.

* * * * *

UNITED STATES PATENT AND TRADEMARK OFFICE

CERTIFICATE OF CORRECTION

PATENT NO. : 8,303,230 B2
APPLICATION NO. : 11/892912
DATED : November 6, 2012
INVENTOR(S) : Hama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1148 days.

Signed and Sealed this
Eleventh Day of August, 2015

Michelle K. Lee

Michelle K. Lee
*Director of the United States Patent and Trademark Office*